United States Patent [19]

Whitehouse

[11] 4,420,997

[45] Dec. 20, 1983

[54] APPARATUS FOR PORTIONING MEAT

[75] Inventor: John A. Whitehouse, Norwich, England

[73] Assignee: AEW Engineering Co. Limited, Norwich, England

[21] Appl. No.: 297,747

[22] Filed: Aug. 31, 1981

[30] Foreign Application Priority Data

Sep. 4, 1980 [GB] United Kingdom ..... 8028634
May 20, 1981 [GB] United Kingdom ..... 8115516

[51] Int. Cl.[3] ..... B26D 7/06

[52] U.S. Cl. ..... 83/105; 83/155; 83/411 A; 83/703; 83/813; 83/522

[58] Field of Search ..... 83/411 A, 703, 813, 83/522, 105, 155

[56] References Cited

U.S. PATENT DOCUMENTS 3,428,102 2/1969 Knecht et al. ..... 83/703 X
3,867,858 2/1975 Tsuchiya et al. ..... 83/411 A X
3,972,256 8/1976 Ross ..... 83/411 A X
4,050,339 9/1977 Soleri ..... 83/411 A X
4,299,150 11/1981 Huston et al. ..... 83/411 A X
4,356,746 11/1982 Whitehouse ..... 83/411 A

*Primary Examiner*—Frank T. Yost
*Attorney, Agent, or Firm*—Gifford, Van Ophem, Sheridan & Sprinkle

[57] ABSTRACT

A machine for portioning meat, comprising a rotatable meat containing drum which moves the meat in a circular path intersecting the cutting flight of a bandsaw, the meat sliding around on a table on to a depth stop in the form of a flush conveyor which assists transport of the meat through the cutting station and to a downstream separating station at which a deflector engages the cut slice of meat below the level of the bandsaw to push said cut slice out from under the main joint, so that the said slice is further transported by the conveyor to an outlet while the main joint is retained by the drum and drops down back on to the table.

11 Claims, 3 Drawing Figures

APPARATUS FOR PORTIONING MEAT

FIELD OF THE INVENTION

This invention relates to apparatus for portioning meat and like comestible articles.

BACKGROUND TO THE INVENTION

In the preparation of meat for consumption, it is usual to separate the carcass into a number of primal cuts and subsequently divide the primal cuts into portions. This portioning has traditionally been effected by hand using knives, saws and cleavers, but in recent years attention has been directed to improving the productivity of the portioning operation in mass production meat processing.

PRIOR ART

Automatic machines are known in which a primal cut resting against a stop is moved in a rotary path into contact with a powered rotating cleaving blade. The severed portion is removed, e.g. by gravity, and the primal cut advanced against the stop for the process to be repeated. An example of such a machine is shown in British Pat. No. 1,057,052. Such machines do not give an entirely satisfactory product. The cleaving blade is thicker in its centre than at its edge, and this produces a curved portion. Secondly, when forming chops and similar "bone-in" portions, the cleaver tends to smash the bone, causing bone fragments to be found in the meat. Both of these factors are unpopular with consumers.

It is also known to make use of a conventional bandsaw (i.e. with a horizontal worktable and a blade band having a vertical operative portion) in cutting chops and the like, the operator manoeuvring the primal cut to and fro onto the blade band. This is dangerous for the operator since it is impossible to fence the blade, and the rate of production is not very high.

We have therefore already proposed an improved apparatus for portioning meat which comprises a bandsaw arranged with a horizontal cutting flight, a meat holder positioned above said flight for rotation about a vertical axis, the meat holder being adapted to hold meat to be portioned substantially vertically at a position spaced from said axis, means for rotating the meat holder about said axis, and a depth stop below said flight, whereby the meat to be portioned is fed across said flight while resting on the depth stop by rotation of the meat holder. In this apparatus, the meat to be portioned is slidingly rotated over a table to an aperture therein through which the meat drops on to the depth stop, which is mounted in a stationary position beneath said aperture. As the meat is driven across the aperture, a slice immediately above the depth stop is cut off by the bandsaw and is immediately separated from the main portion of meat rotating in the meat holder to enable said main meat portion to return to the table at the end of the aperture. The cut meat portion is fed out from below the table to an outlet chute.

OBJECT OF THE INVENTION

With the proposed machine, it has been found that occasionally a cut portion of meat can stick between the bandsaw and the depth stop, or stick to the main portion of meat which is to be returned to the table. This results in jamming of the machine, with possible damage to said machine and wastage of meat, and is especially liable to happen when the machine is operated at high speed, which is desirable not only to maximize production but also for maximum cutting efficiency of the bandsaw. It is therefore an object of the present invention to provide improved apparatus for portioning meat which substantially avoids the above-described disadvantage of the previously proposed machine.

THE INVENTION

According to the invention, there is provided apparatus for portioning meat, comprising a bandsaw arranged with a generally horizontal cutting flight, a meat holder, driving means for moving said meat holder, thereby in use to move the meat to be portioned in a path intersecting the cutting flight at a cutting station, a depth stop below the cutting flight for supporting such meat during its movement through the cutting station, means for moving said depth stop in a path of movement through the cutting station which corresponds to the path of movement of the meat being moved by the meat holder, said two movements being substantially synchronised, and separating means at a separating station downstream of the cutting station for separating a cut portion of meat for transport on the depth stop from a remaining portion of meat retained by the meat holder.

Thus, in accordance with the invention, risk of jamming is minimized by moving the cut meat portion in synchronism with the remaining meat portion away from the bandsaw, and splitting off the cut meat portion at a point downstream of the bandsaw.

FURTHER FEATURES OF THE INVENTION

Preferably, in order to assist the action of the separating means, the path of movement of the depth stop diverges from the path of movement of the remaining portion of the meat in the region of the separating station.

The meat holder is preferably driven to move the meat in a closed path which returns the remaining portion thereof from the separating station to the cutting station. Thus, in a practical embodiment, the meat holder is mounted to rotate about a generally vertical axis to one side of the bandsaw, whereby the meat to be portioned is driven through the cutting station in a circular path. In this machine, the depth stop moves at the cutting station in a circular path of movement corresponding to that of the meat and downstream of the cutting station diverges from said circular path in an arc of increased radius. Conveniently, in its return movement from a point adjacent the separating station to a point adjacent the cutting station, the meat retained by the meat holder is supported on a stationary table. In the preferred machine, the depth stop is substantially flush with the surface of the table.

It is, of course, desirable to be able to vary the thickness of the portion of meat being cut. Preferably, therefore, the thickness of the cut meat portion is variable by adjustment of the relative levels of a bandsaw assembly and a meat holder and depth stop assembly. In the preferred machine, this means of adjustment enables the depth stop to be maintained in flush relationship with the table.

The separating means preferably comprises a deflector positioned just below the level of the bandsaw cutting flight at the separating station. Conveniently, this deflector may have a ramp-like upper surface down which the remaining portion of the meat can slide, within the confines of the meat holder, laterally relative to the path of the moving depth stop. It is desirable for the deflector to be yieldable under pressure from the cut meat portion, and a detector may be provided to detect yielding of the deflector beyond a predetermined amount and thereby provide an output for power cut-off or alarm purposes. The deflector will so yield, of course, if the cut portion of meat will not readily split off from the remaining meat portion, for example because a "rough" cut has occurred due to bone breakage or splintering or the like. The required yielding movement of the deflector may be afforded by a biassing spring, which may enable the deflector to move downardly out of the path of the meat or swing inwardly about a vertical pivot axis out of the path of the meat.

To enable the deflector to operate efficiently at differing thicknesses of cut, it is preferably mounted in fixed relationship to the bandsaw assembly. Alternatively, interchangeable deflectors of differing depths may be provided.

The movable depth stop preferably comprises an endless conveyor, which may conveniently take the form of a slatted supporting surface adapted to conform to a curved path of movement in the plane of said surface, said slatted surface being driven from below by means of a flexible chain. In the preferred machine, the table has an elongated aperture accommodating the top run of the conveyor, the longitudinal edges of the table aperture having depending lipped flanges which are engaged by grooves in the end edges of the conveyor slats, whereby the top run of the conveyor is accurately guided along the table aperture flush with the surface of said table.

A guard will be provided for the bandsaw and meat holder. Preferably said guard will have an openable panel to permit loading of the meat holder, and an interlock means being provided to interrupt the driven movement of the meat holder and depth stop when said panel is opened. A further interlock may be provided to interrupt the drive to the meat holder, depth stop and the bandsaw if any other part of the guard is removed. In addition, a sensor is preferably provided for detecting a defective bandsaw and acting when operated to interrupt the drive to the meat holder, depth stop and the bandsaw.

Two meat holder, depth stop and bandsaw units may be accommodated within a single housing, utilising a common drive, at least in part, to the two bandsaws. The arrangement will be such that the swarf or meat dust generated at the respective cutting stations is thrown clear of both units (i.e. neither unit is positioned downstream of the other unit in the path of the ejected swarf), conveniently towards a downstream site at which a collecting bin may be located.

A typical linear speed of movement of the bandsaw blade, for portioning most meats, is generally in the range 3000 to 6000 feet per minute. However, with certain high density compressed meats, such a linear blade speed can result in the blade teeth becoming filled with frozen meat, as a result of which the saw may cease to function correctly.

This problem can be overcome by reducing the speed of advance of the meat through the blade, but this reduces output and therefore also reduces the economic usefulness of the apparatus.

Preferably, therefore, the blade of the bandsaw is exchangeable to substitute a blade of selected teeth pitch, and means are provided for adjusting the speed of the driving means for the meat holder and depth stop and for adjusting the linear speed of the bandsaw. Conveniently, a meat-type selector means is provided wherein indicators can be adjusted to select a type of meat and thereby automatically effect adjustment of the speed controls to suit the selected meat type.

Thus, to enable efficient cutting of highly compressed meats, the apparatus can be operable with a high speed of meat advance, a reduced number of teeth per inch in the bandsaw blade and an increased linear speed of said blade. It is found that by using a linear blade speed of some 15,000 feet per minute with a tooth pitch of three teeth per inch and a feed rate of some thirty revolutions per minute of the cylindrical drum containing the hunks of meat to be portioned, high density compressed meat of some four to six inches diameter can be cut without difficulty. As above mentioned, the normal blade speed is of the order of some 3000 to 6000 feet per minute and the surprising effect of increasing this to about 15,000 feet per minute is that the blade does not become more saturated with frozen meat quicker than in the case of the more slowly moving blade. It is believed that the high speed of the blade in fact creates a local momentary heating of the meatstuff and this allows even high density compressed frozen meat to be portioned.

DESCRIPTION OF EMBODIMENT

Figure 1:
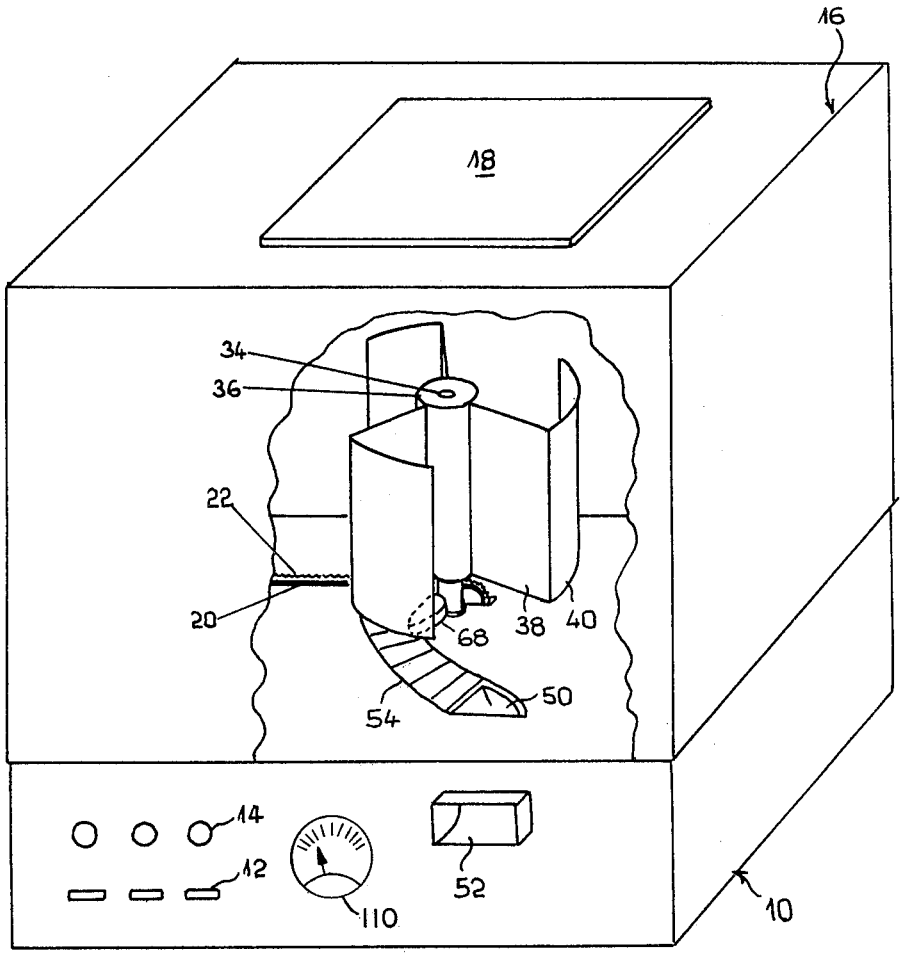
FIG. 1 is a diagrammatic perspective view of one embodiment of apparatus in accordance with the invention, with the guard cut away.

The apparatus comprises a base housing 10 having control switches 12 and indicators 14, surmounted by a guard housing 16 including an access panel 18 for loading. Other sections (not shown) of the guard housing 16 will be removable to facilitate servicing and maintenance.

Figure 3:
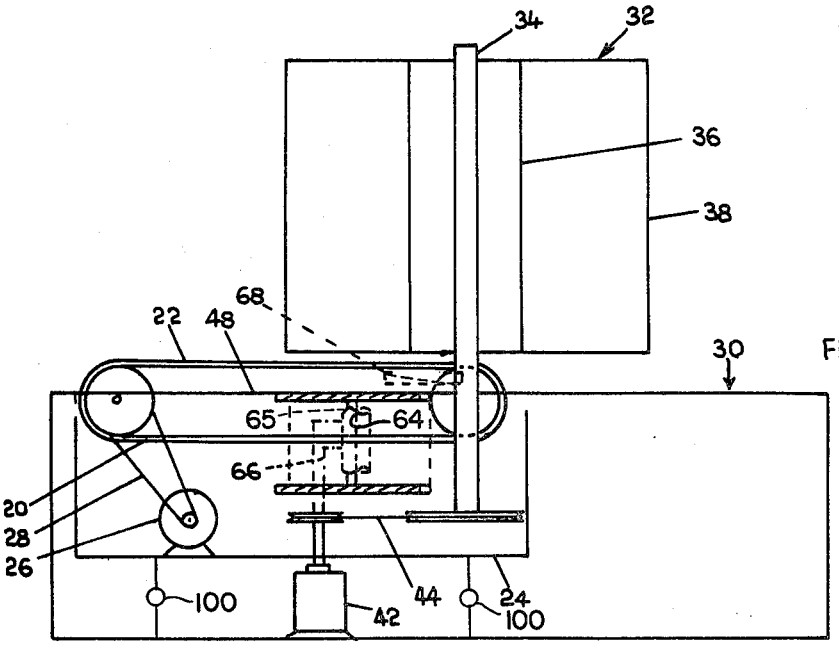
FIG. 3 is a diagrammatic vertical cross-sectional view of the apparatus, again with the guard removed.

As shown in FIG. 3, a bandsaw 20 having a cutting flight 22 is mounted on a frame 24 within the base housing 10. The bandsaw is driven by an electric motor 26 and belt drive 28. The cutting flight 22 of the bandsaw is disposed at a level above the top surface of the base housing 10, which top surface constitutes a horizontal table 30.

A meat cylinder assembly 32 is mounted over the table 30. This assembly has a vertical central shaft 34 on which is fixedly mounted a meat holder comprising a sleeve 36 from which project radial plate members 38 bent to form circumferential wings 40. The shaft 34 is drivable in rotation about its vertical axis by means of an electric motor 42 and transmission 44. It is to be noted that the lower edges of the meat holder formed by the elements 36, 38, 40 lie in a plane above the level of the cutting flight 22 of the bandsaw 20. Thus, in use, the meat cylinder assembly 32 is driven in rotation so that the meat holder rotates above the table 30, whereby a joint of frozen meat 46 (see FIG. 2) retained in each of the compartments of the meat holder is moved in a circular path, with the underside of the meat sliding on the table 30. This circular path of the meat 46 intersects the cutting flight 22 of the bandsaw 20, whereby a slice of meat will be cut off at the bottom of the joint, the thickness of the cut slice corresponding to the height of the cutting flight 22 above the table 30. Means 100 for raising and lowering the bandsaw frame 24 thereby varying the height of the bandsaw 20 relative to the table 30, thereby to adjust the thickness of the cut slice of meat.

In association with the path of movement of the meat in the meat cylinder assembly 32, the table 30 is formed with an elongate curved aperture 48 starting from just before the point where the meat is cut (the cutting station), extending in a circularly curved path matching that of the meat to a point beyond the cutting station, and then diverging from the path of the meat retained by the meat cylinder assembly 32, in an arc of increased radius, to the entrance 50 to an outlet chute 52.

Figure 2:
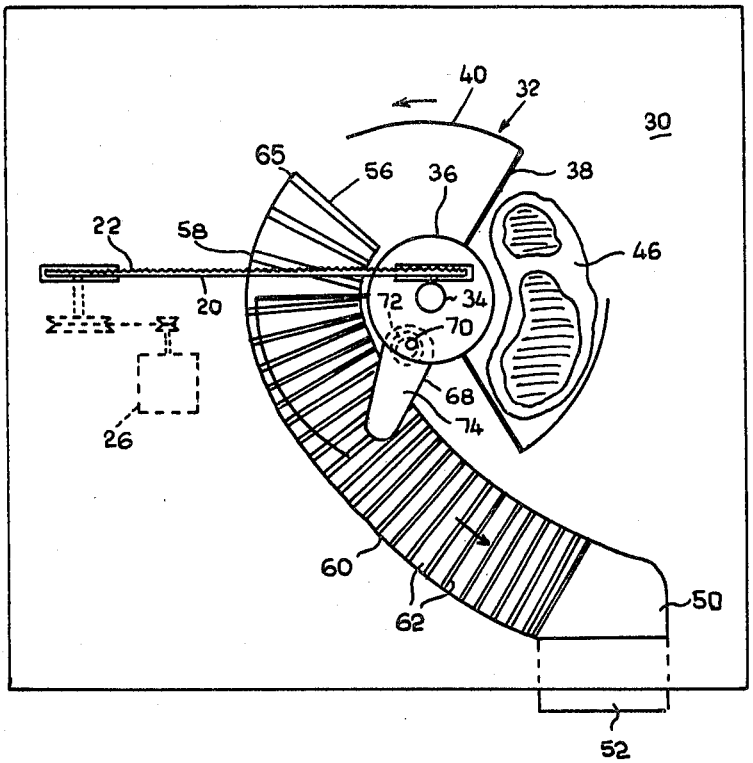
FIG. 2 is a diagrammatic plan view of the apparatus, with the guard removed.

This aperture 48 in the table 30 is closed by a conveyor 54 flush with said table 30. This conveyor 54 in effect constitutes a moving depth stop for the meat. In FIG. 2, the starting point of the conveyor is referenced 56, its curved portion through the cutting station is referenced 58, and its diverging portion of greater radius is referenced 60. In practice, the conveyor is of the slatted endless loop type, the individual slats 62 being linked in a manner which permits the conveyor to conform to the curved path of movement above described. The slats 62 are driven by a roller 65 situated at one end of the conveyor coupled to a driven chain 64 (see FIG. 3), having a drive transmission 66 connected to the output of the motor 42 driving the meat cylinder assembly 32. Such a common drive for the meat cylinder assembly 32 and the moving depth stop 54 is not essential; however it facilitates the essential requirement for the moving depth stop 54 to be driven in synchronism with the meat 46 through the cutting station, so that there is no relative movement between the underside of said meat and the depth stop. Thus, after a meat slice has been cut, the meat continues to move away from the cutting station with the remainder of the joint supported on the cut slice and without any relative movement therebetween tending to separate or split off the cut slice.

Downstream of the cutting station, a deflector or plough 68 is provided to separate or split off the cut meat slice. The separating station thus defined is positioned adjacent the point of the conveyor 54 where the latter starts to diverge from the path of movement of the meat retained by the meat cylinder assembly 32 into an arc of greater radius, i.e. generally at the junction of the conveyor portions 58 and 60.

The plough 68 is mounted to pivot, under the pressure of the cut meat slice, about a vertical axle 70, against the biassing action of a strong coil spring indicated at 72. Assuming the slice has been properly cut, it is pushed by the plough 68 outwardly of the path of movement of the remainder of the joint, to maintain the transport of the cut slice on the conveyor, which also serves as a take-off conveyor feeding the outlet chute 52. The plough 68 passes under the main meat joint and has its upper surface contoured generally in ramp-like form, as indicated at 74, to assist the downward and inward movement of the main meat joint, within the confines of the relevant compartment of the meat cylinder assembly 32, back on to the table 30. Thus, the meat cylinder assembly 32 retains the main joint and moves it around in a circular path back to the cutting station, ready for a further slice to be cut from the bottom of the joint. The depth of the plough 68 is such, as indicated in FIG. 3, that it only presses on the cut slice of meat. It is, therefore, located at the level of the space between the bandsaw cutting flight 22 and the table 30. To enable the same plough 68 to deal with cut meat slices of differing thicknesses, the plough 68 and its mounting means 70, 72 are preferably carried by the bandsaw frame 24 to be adjustable therewith relative to the table 30.

In connection with the conveyor 54, although not shown in the drawings, it should be mentioned that the elongate aperture 48 in the table 30 has depending lipped flanges along its longitudinal edges, which lipped flanges are engaged by grooves or slots in the end edges of the conveyor slats, thereby both to ensure accurate guiding of the top run of the conveyor 54 along the required path and to ensure a flush relationship with the table 30.

Loading of meat into the meat cylinder assembly 32 is effected through the panel 18 in the guard housing 16. The removal of this panel 18 automatically brakes the assembly 32 and conveyor 54 (while leaving the bandsaw running normally), thereby to enable the assembly 32 to be indexed round while successive compartments (which may number more than three depending on the nature of the primal cuts or joints of meat to be sliced) are loaded. Indexing can be effected manually or automatically. In addition, a further interlock may serve to cut off the power to the machine if any other section of the guard housing 16 is removed, while a bandsaw sensor may raise an audible or visual alarm responsive to stretching or breakage of the bandsaw.

Means is provided, via control switches 12 and motor 42, for adjusting the speed of rotation of the meat carousel on which the pieces of meat are mounted for cutting and means is provided by varying the speed of the motor 26 through control switches 12, for adjusting the linear speed of the bandsaw in the range 3000 to 30,000 feet per minute. A speed in the upper part of the range facilitates the portioning of dense, compressed meats. According to another feature, display means 110 is provided in association with the speed controls which indicates the preferred speeds of operation for different types of meat, sizes of cut, densities, steaks (frozen or partially frozen etc.) and other related variables. By adjusting the controls so that the indicators point to the type etc. of meat concerned so the appropriate speeds of operation will automatically be selected.

Where a single pitch blade cannot be used over the total speed range available further warning indicator means may be provided to indicate that the wrong pitch of blade is in use if a particular speed of feed or linear blade speed has been selected. Means is also provided for changing the blade easily and rapidly, more especially to substitute a blade of different teeth pitch.

Finally, two units comprising meat cylinder assembly, bandsaw and moving depth stop may be contained within a single composite housing, the relative positioning of the units side-by-side being such that swarf or cut meat dust is thrown clear of both units to a downstream collecting bin.

We claim:

1. Apparatus for portioning meat, comprising a bandsaw having a generally horizontal cutting flight, a meat holder, driving means for moving said meat holder, thereby in use to move the meat to be portioned in a path intersecting the cutting flight at a cutting station, a depth stop below the cutting flight for supporting such meat during its movement through the cutting station, means for moving said depth stop in a path of movement through the cutting station which corresponds to the path of movement of the meat being moved by the meat holder, means for substatially synchronizing said two movements, and separating means at a separating station downstream of the cutting station for separating a cut portion of meat for transport on the depth stop from a remaining portion of meat retained by the meat holder.

2. Apparatus according to claim 1, wherein the path of movement of the depth stop diverges from the path of movement of the remaining portion of the meat in the region of the separating station, and the separating means comprises a deflector positioned just below the level of the bandsaw cutting flight at the separating station.

3. Apparatus according to claim 2, including means for spring loading the deflector, which has a ramp-like upper surface down which the remaining portion of the meat can slide, within the confines of the meat holder, laterally relative to the path of the moving depth stop.

4. Apparatus according to claim 3, including means for adjusting the relative levels of a bandsaw assembly and a meat holder and depth stop assembly in order to vary the thickness of the cut meat portion, and means for mounting the deflector in fixed relationship to the bandsaw assembly.

5. Apparatus according to claim 4, wherein the meat holder is mounted to rotate about a generally vertical axis to one side of the bandsaw, whereby the meat to be portioned is driven through the cutting station in a circular path, and the depth stop moves at the cutting station in a circular path of movement corresponding to that of the meat and downstream of the cutting station diverges from said circular path in an arc of increased radius.

6. Apparatus according to claim 1, including a stationary table, and the meat retained by the meat holder, in its return movement from a point adjacent the separating station to a point adjacent the cutting station, is supported on the stationary table, the surface of the movable depth stop being substantially flush with the surface of the table.

7. Apparatus according to claim 1, wherein the movable depth stop comprises an endless conveyor constituted by a slatted supporting surface adapted to conform to a curved path of movement in the plane of said surface, and a flexible chain for driving said slatted surface from below.

8. Apparatus according to claim 1, wherein the meat holder is mounted to rotate about a generally vertical axis to one side of the bandsaw, whereby the meat to be portioned is driven through the cutting station in a circular path, and the depth stop moves at the cutting station in a circular path of movement corresponding to that of the meat and downstream of the cutting station diverges from said circular path in an arc of increased radius.

9. Apparatus according to claim 1 wherein the bandsaw blade is exchangeable to substitute a blade of selected teeth pitch.

10. Apparatus according to claim 1 wherein means are provided for adjusting the linear speed of the bandsaw blade.

11. Apparatus according to claim 1 further comprising meat-type selector means whereby automatic adjustment of speed controls to suit the selected meat-type is effected.

* * * * *

UNITED STATES PATENT AND TRADEMARK OFFICE

CERTIFICATE OF CORRECTION

PATENT NO. : 4,420,997

DATED : December 20, 1983

INVENTOR(S) : John A. Whitehouse

It is certified that error appears in the above-identified patent and that said Letters Patent is hereby corrected as shown below:

Column 7, claim 1, line 1, "substatially" should read --substantially--.

Signed and Sealed this

*Fifth* Day of *February 1985*

[SEAL]

*Attest:*

DONALD J. QUIGG

*Attesting Officer*

*Acting Commissioner of Patents and Trademarks*